US007322827B2

(12) United States Patent
Frawley et al.

(10) Patent No.: US 7,322,827 B2
(45) Date of Patent: Jan. 29, 2008

(54) TWO-PIECE HOUSING RECONFIGURABLE WITH AN INTEGRAL HINGE

(75) Inventors: Lanny J. Frawley, St. Charles, IL (US); Andrew A. Kuester, South Elgin, IL (US); Zoltan Borbath, Lombard, IL (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 11/280,614

(22) Filed: Nov. 16, 2005

(65) Prior Publication Data

US 2007/0111572 A1 May 17, 2007

(51) Int. Cl.
*H01R 39/00* (2006.01)

(52) U.S. Cl. ..... 439/31; 439/165; 439/913

(58) Field of Classification Search ..... 439/31, 439/32, 165, 534, 713, 913
See application file for complete search history.

(56) References Cited

U.S. PATENT DOCUMENTS

| | | | | |
|---|---|---|---|---|
| D327,228 | S | 6/1992 | Fenne | D10/104 |
| 6,124,795 | A * | 9/2000 | Bernau et al. | 340/628 |
| 6,897,774 | B2 | 5/2005 | Costa | |
| 6,926,546 | B2 * | 8/2005 | Kurokawa | 439/165 |

OTHER PUBLICATIONS

"Application Guide: Duct Application Smoke Detectors;" 2002—System Sensor; Pub. No. A05-1004-003; 14 pages.
"Product Description: Duct Smoke Detectors 2650-400 Series;" Oct. 4, 2005—Robertshaw, 3 pages.
"Installation Instructions For Universal Duct Smoke Detectors;" Jan. 2001—FIREX; Pub No. AP 186 MA 2650-760; 6 pages.
"Duct Probe Smoke Detectors;" 2002—Westminster Int'l; 1 page.

* cited by examiner

*Primary Examiner*—Khiem Nguyen
(74) *Attorney, Agent, or Firm*—Welsh & Katz, Ltd.

(57) ABSTRACT

An electrical unit has first and second attached housing sections. The sections are movable relative to one another and include internal conduits and conductors that extend between the sections.

10 Claims, 12 Drawing Sheets

TWO-PIECE HOUSING RECONFIGURABLE WITH AN INTEGRAL HINGE

FIELD

The invention pertains to electrical units that have multi-sectional housings. More particularly, the invention pertains to such units where electrical conductors extend between movable housing sections.

BACKGROUND

Duct mountable smoke or gas detectors are often useful in connection with alarm systems to control the movement air in building ducts associated HVAC systems. One such duct detector structure has been disclosed in U.S. Pat. No. 6,124,795 entitled "Detector Interconnect System", issued Sep. 26, 2000. The '795 patent is assigned to the Assignee hereof and incorporated herein by reference. Another variation is illustrated in Fenne U.S. Design Patent DES. 327,228 issued Jun. 23, 1992. The Fenne patent is assigned to the Assignee hereof and incorporated herein by reference.

Known duct detector housings have been implemented with either one piece or two piece enclosures. The sensor and power electronics are usually separated. The sensor portion is sealed in accordance with agency requirements.

As a result of the sealed sensor, electrical conductors or other forms of interconnects extend between the respective enclosures or compartments. Additionally, there are times when there is inadequate space available for purposes of installing a one-piece housing. While two-piece housings reduce space requirements, separate wiring harnesses or conduit connections must be provided between the two housing portions. The wiring is thus exposed to potential hazards of the environment. Further, whether the detectors are installed in wet or unclean environments, special connectors often must be used to interconnect the two sections.

There is thus a continuing need for improved duct-type detectors to address some of the outstanding installation and environmental related problems noted above. Preferably such footprint and/or interconnect problems could be addressed in a way that installers can operate more cost effectively and efficiently while at the same time minimizing problems due to separate, inconvenient and expensive wiring harnesses.

DETAILED DESCRIPTION

Figure 1:
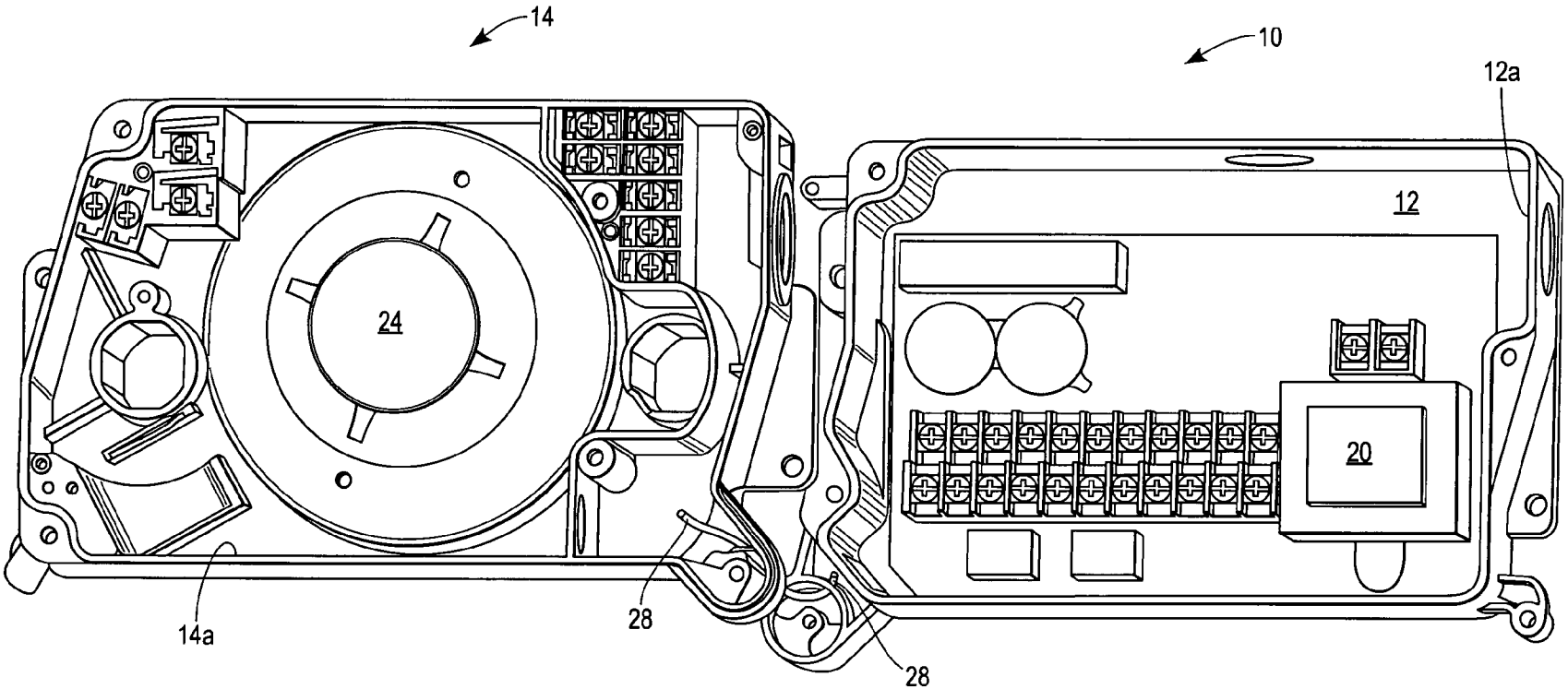
FIG. 1 is a top plan view of an electrical unit which embodies the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Multiple segmented housings for electrical units in accordance with the present invention provide easy and convenient adjustment of the housing shape and footprint of the unit. Housing sections can be pivotably or slidably attached to one another all without limitation. Pivoted housing sections can be positioned on an arc relative to another to any position from zero degrees, overlying one another, to 180 degrees, extending linearly from one another.

Housings for electrical units in accordance with the invention are particularly advantageous in that the units can continue to be installed with standard fasteners or the like at their normal locations. Where the electrical unit corresponds to a multiple segmented duct detector, the unit can be attached to a portion of a respective duct or roof top or other enclosure with an adjustable footprint dictated by the mounting environment. Such units are particularly advantageous in that electrical interconnections between the housing sections are enclosed completely within the respective housing sections notwithstanding the relatively alterable positions therebetween. This provides protection, convenience and ease of installation in that separate wiring harnesses are unnecessary. Further, since all interconnects are within a controlled environment, namely, the two housing sections, less expensive electrical wiring and connectors can be used than is the case where external wiring harnesses are required.

FIG. 1 illustrates an electrical unit, configured as a duct detector 10. The detector 10 is implemented with first and second housing sections 12, 14. The sections 12, 14 each define an internal component receiving region, 12*a* and 14*a*. The regions in 12*a*, 14*a* in normal usage are closed with respective covers, not illustrated.

The region 12*a* in the illustrative embodiment of FIG. 1, incorporates control circuitry 18 as would be understood by those of skill in the art as well as one or more connector blocks 20 for interconnecting the detector 10 with an external environment. It will be understood that neither the control circuitry 18 nor the configuration of the connector blocks 20 are limitations of the present invention.

Housing section 14 incorporates in region 14*a* an ambient condition sensor indicated generally at 24. Sensor 24 which could be implemented as a smoke sensor, a gas sensor, or any other form of ambient condition sensor including a flame sensor, position sensor, infrared sensor, velocity sensor, thermal sensor, flow sensor or combinations thereof, all without limitation. The circuitry 18 and sensor 24 are interconnected by electrical conductors indicated generally at 28 which are completely within one or the other of housings 12, 14.

The housings 12, 14 carry respective hollow hinge structures 12*b*, 14*b* which are pivotably attachable to one another. When so attached, the sections 12, 14 form a singular detector structure with two rotatably adjustable sections 12, 14.

Figure 1A:
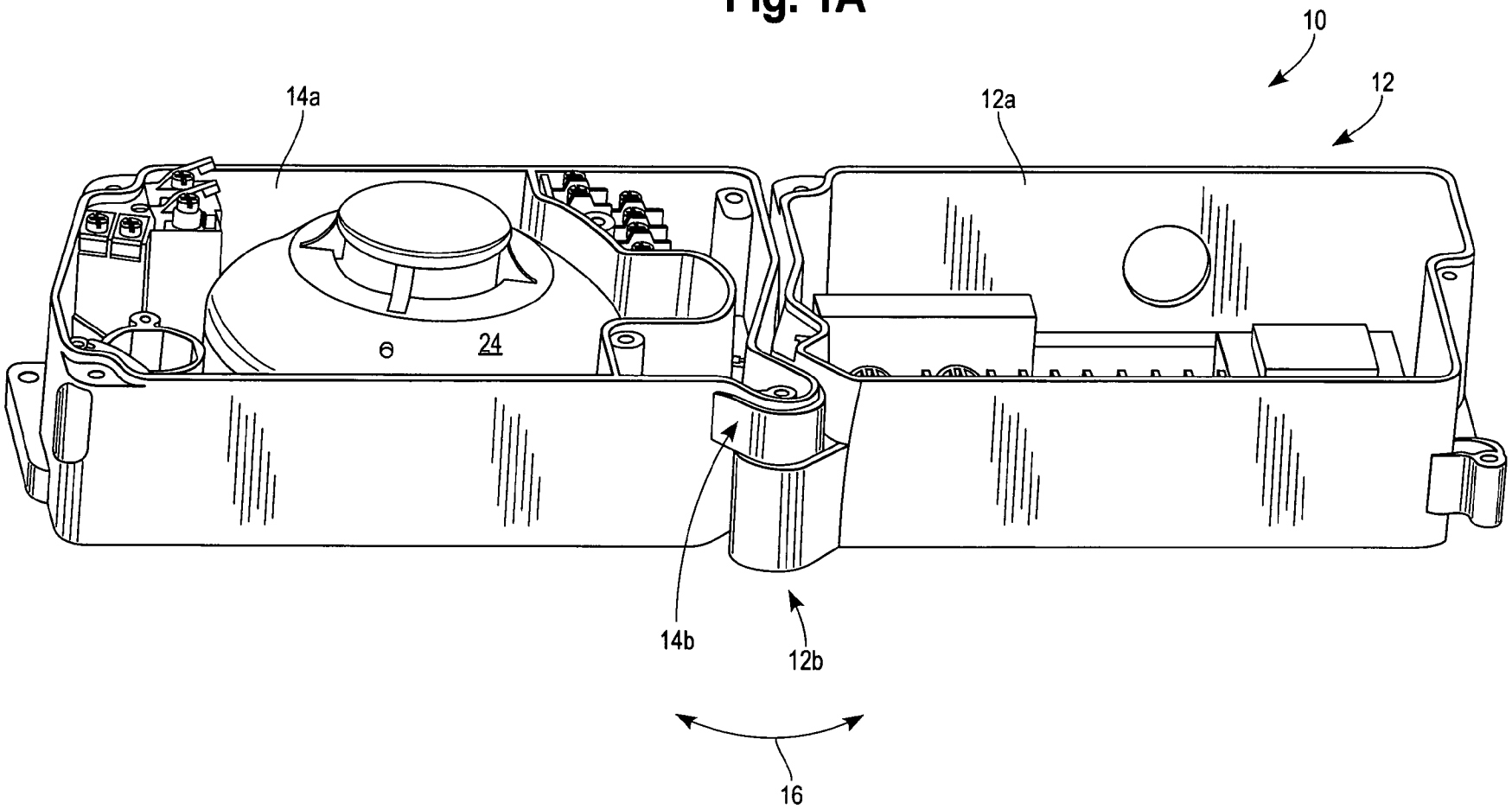
FIGS. 1A, 1B and 1C are views illustrating various footprints of detectors that embody the present invention.
Figure 1B:
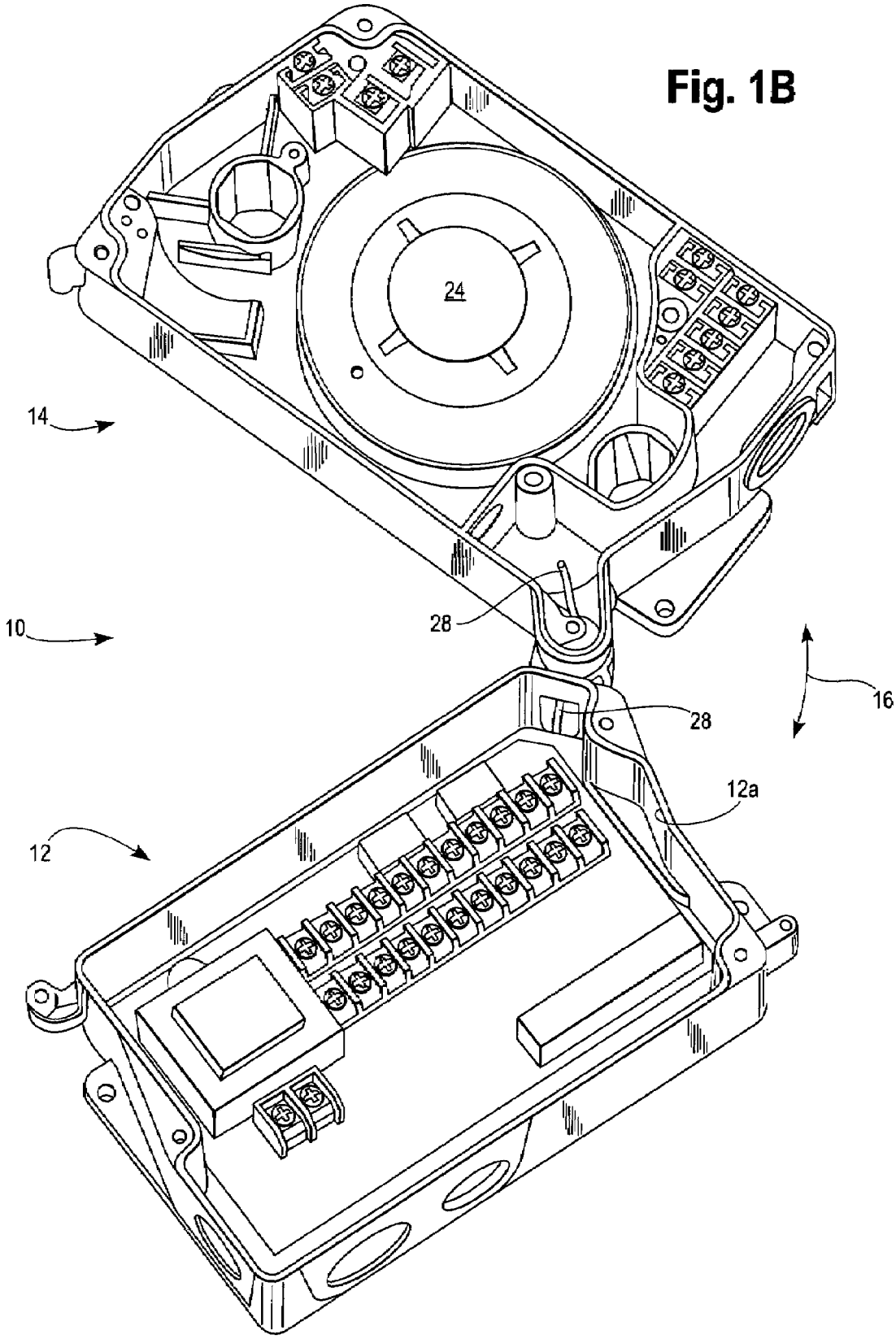
Figure 1C:
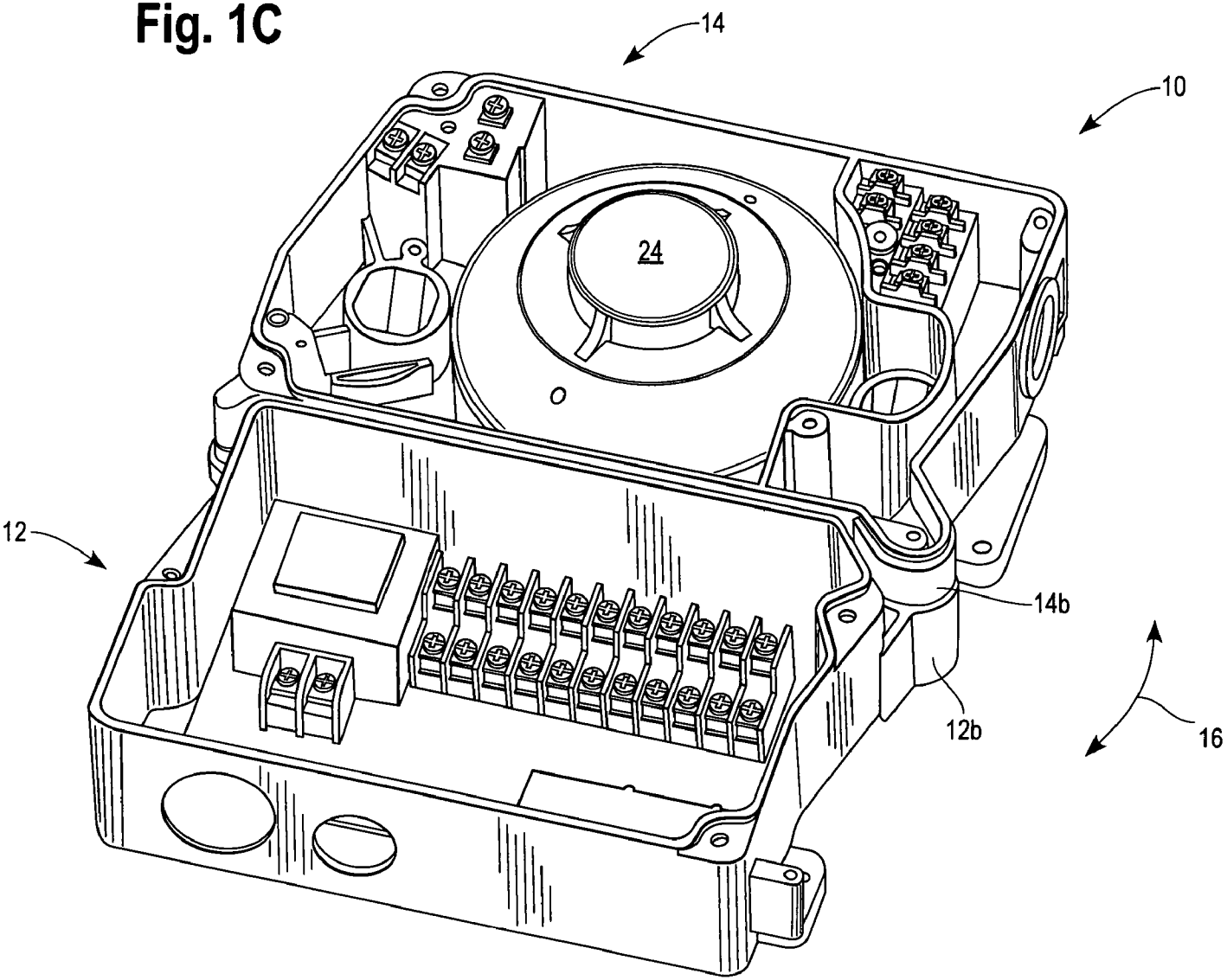

As illustrated in FIGS. 1A, 1B the sections 12, 14 are rotatable about an arc 16 (from zero to one-hundred eight degrees) relative to one another. The sections 12, 14 can overlie one another, as in FIG. 1C, extend at an angle less than ninety degrees to one another as in FIG. 1B, or, extend axially as in FIG. 1A.

Figure 2:
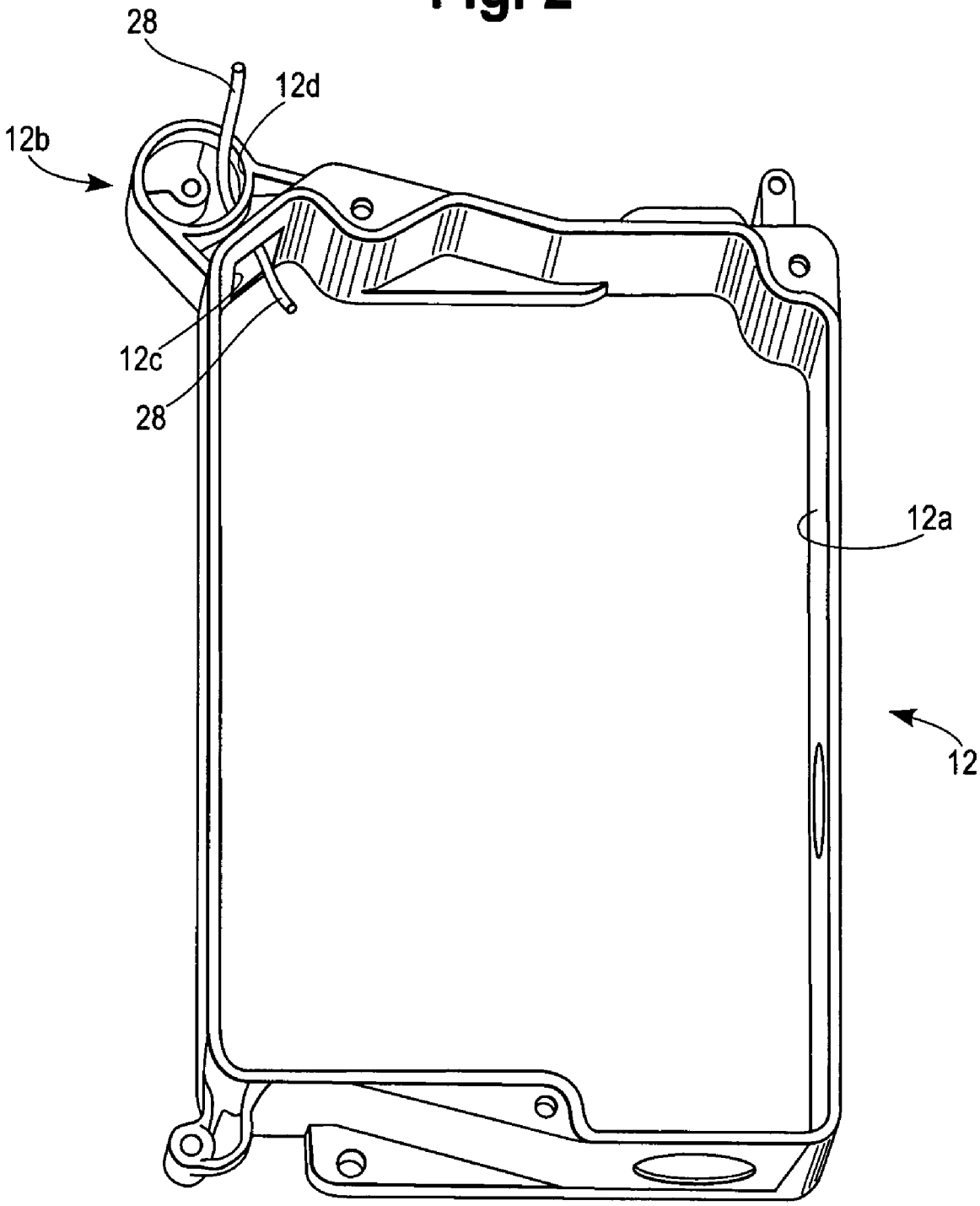
FIG. 2 illustrates further details of one of the housing sections of FIG. 1.
Figure 3:
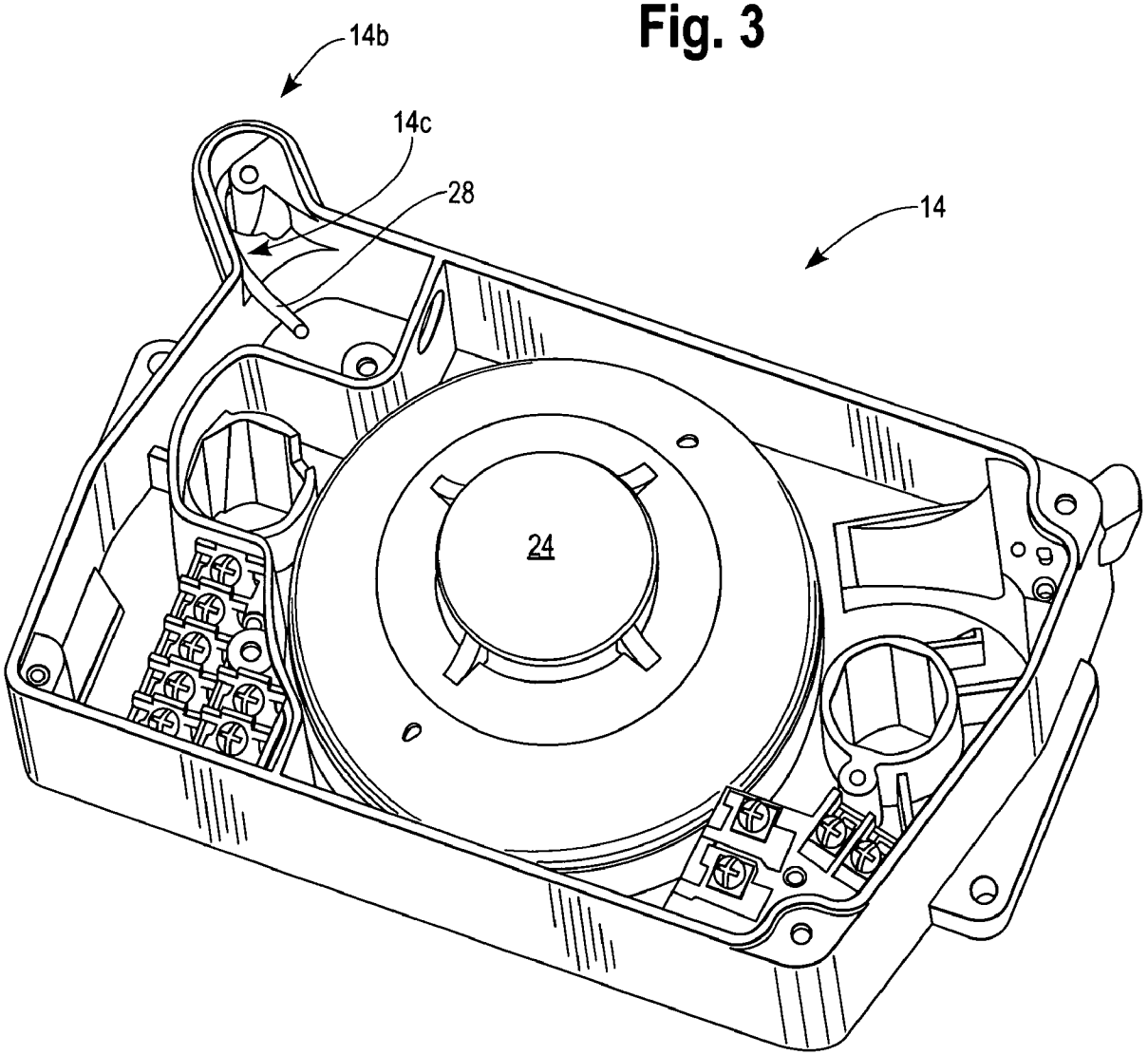
FIG. 3 illustrates additional details of the other of the housing sections of FIG. 1.

The conductors 28 extend between the housing sections 12, 14 through apertures in the hinge members 12*b*, 14*b*, best seen in FIGS. 2, 3 (as well as FIGS. 4A-D). As illustrated therein, each of the respective hinge sections 12*b*, 14*b* includes an aperture such as the aperture 12*c*, see FIG. 2 which extends toward the respective interior region 12*a*. A second aperture 12*d* is located at a displaced end of a pathway between the apertures 12*c*, 12*d*. Similar comments apply to aperture 14*c* of housing section 14, best seen in FIG. 3.

When the hinged sections 12*b*, 14*b* are fixedly attached to one another, thereby providing for pivotal movement between the housing sections 12, 14 (see FIGS. 1A, 1B and 1C) a variety of different installation footprints are available. The respective hinge apertures 12*d*, 14*d*, continue to be aligned irrespective of the location of the sections 12, 14 relative to one another. Hence, the electrical conductors 28 can extend from the interior region in 12*a* through the respective hinge pathway from aperture 12*d* into aperture 14*d* and then from aperture 14*c* into region 14*a*. The conductors can carry signal or electrical energy between the housing sections 12, 14 without limitation as would be understood by those of skill in the art.

An annular seal 12-1 can be located between hinged sections to 12*b*, 14*b*. If desired, the sections 12, 14 can be locked in the axial position as in FIG. 1A or the fully rotated position FIG. 1C by a single fastener. Multiple fasteners or other locking means could also be used without departing from the spirit and scope of the present invention.

Figure 4A:
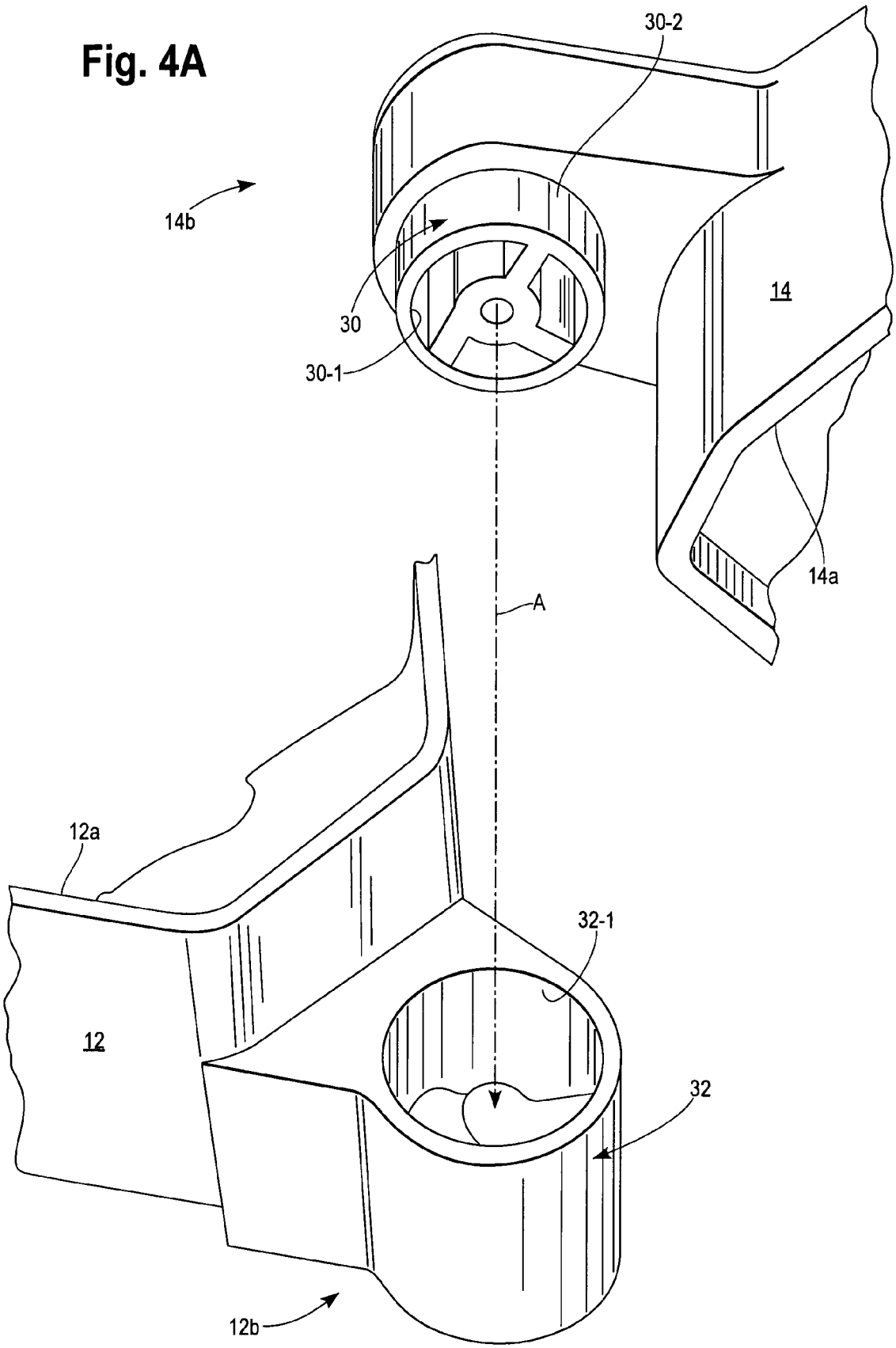
FIGS. 4A, B, C, D and E illustrate various aspects of hollow hinges in accordance with the invention.
Figure 4B:
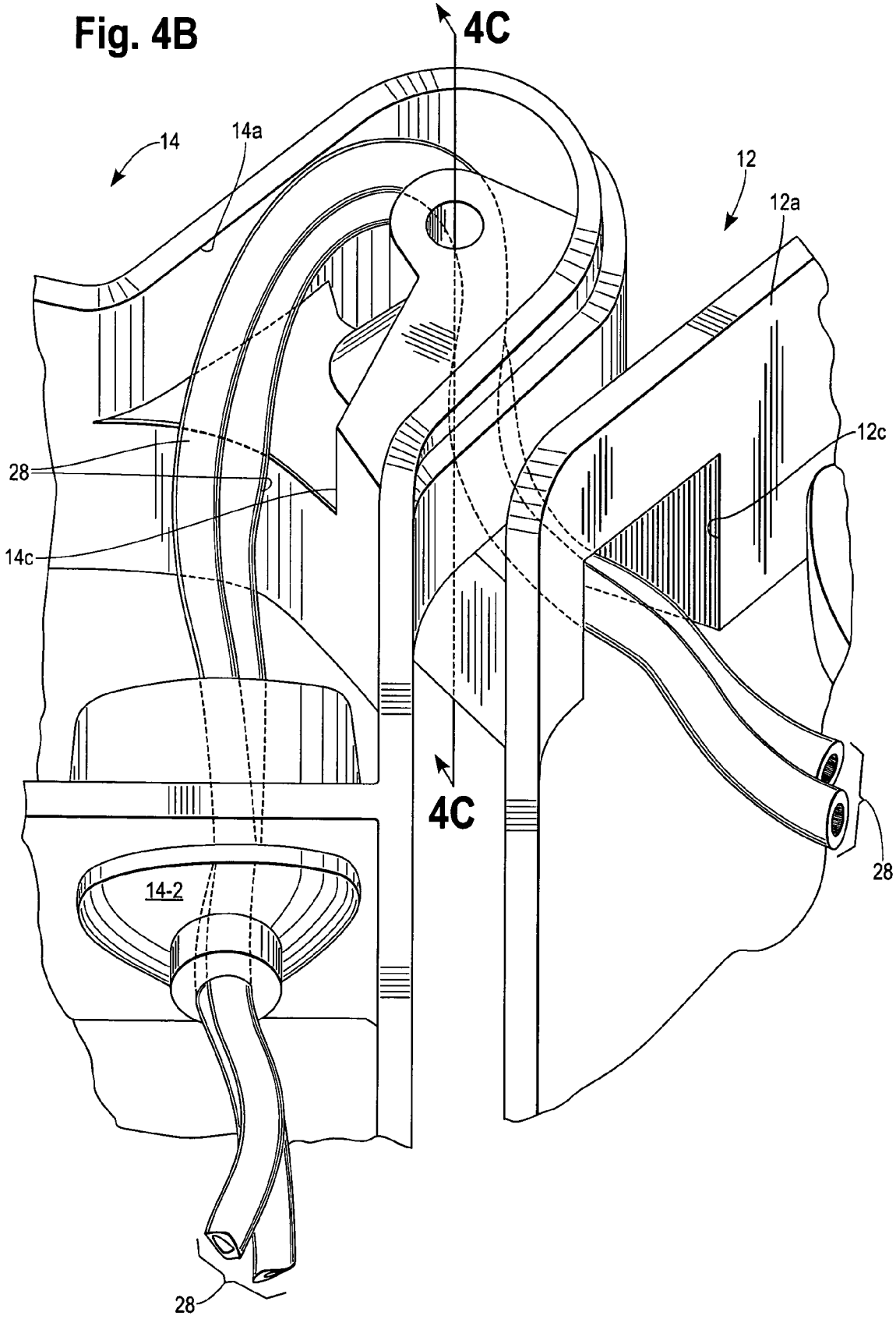

FIGS. 4A and 4B illustrate various aspects of the structure of the hinged sections 12*b*, 14*b*. Hinged section 14*b*, best seen in FIG. 4A, carries a cylindrical protrusion 30. The protrusion 30 is in part hollow and has a interior curved bounding wall 30-1. A ring-type seal 30-2, shown in phantom, see FIG. 4A, can be provided on protrusion 30. Seal 30-2 is trapped and slightly compressed as the hinge pieces are drawn together, perhaps by a fastener such as a screw.

The hinged section 12*b* defines an exterior cylindrical protrusion 32 and an interior bounding surface 32-1. The protrusion 30 mates with the protrusion 32 and rotatably engages same. The housing sections 12, 14 rotate relative to one another around common axis A.

Both protrusions or members 30 and 32 define internal channels 36*a*, 36*b* (best seen in FIG. 4C) through which wiring 28 can extend between housing sections 12, 14. The configuration of the hinged sections 12*b*, 14*b* results in an enclosed passageway between sections 12, 14 for wiring 28. The housing section 14 can also carry a seal 14-2, best seen in FIG. 4B through which the wiring 28 can extend. Seal 14-2 provides a pressure seal for region 14*a* of the housing 14.

Figure 4C:
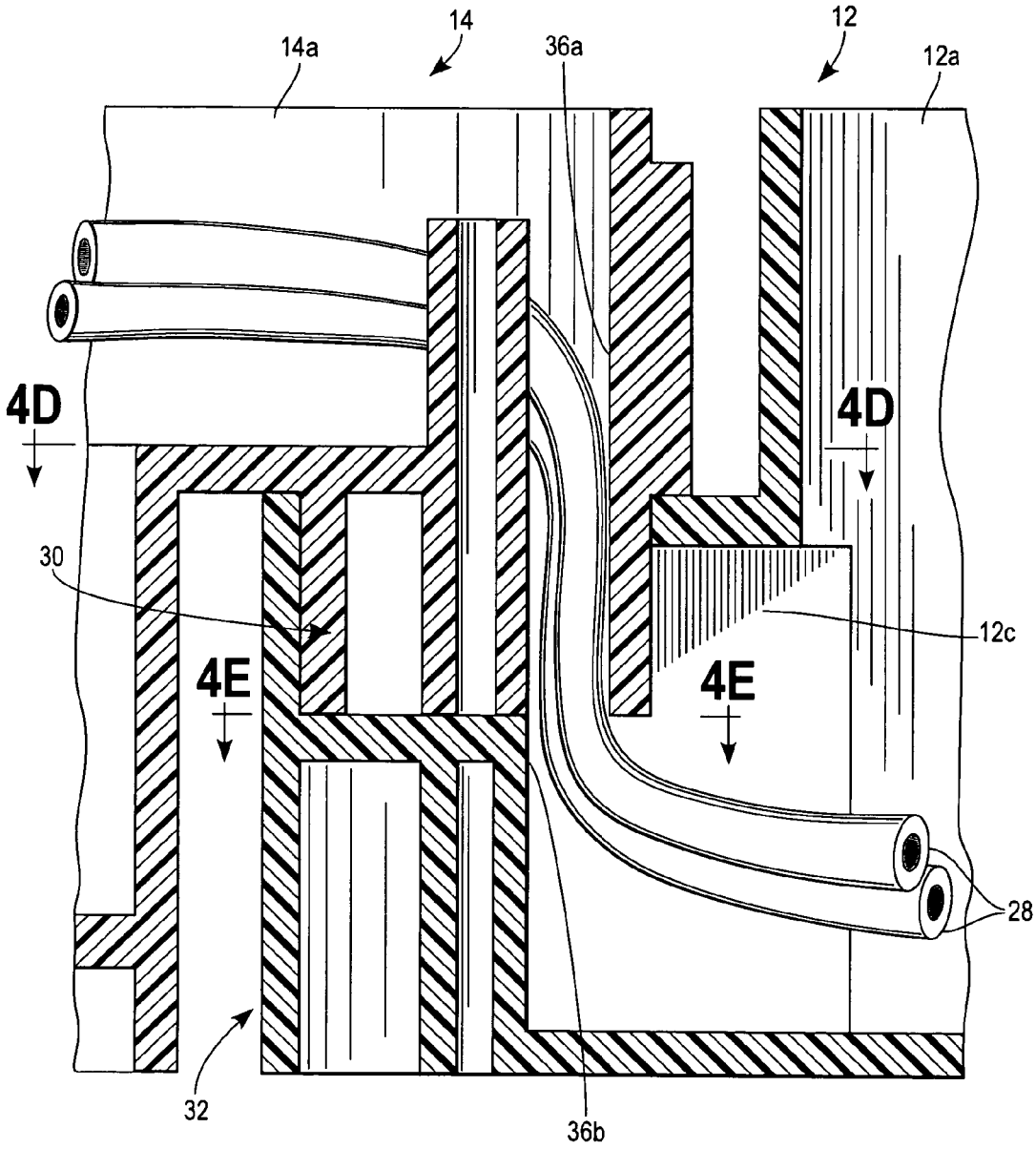
Figure 4D:
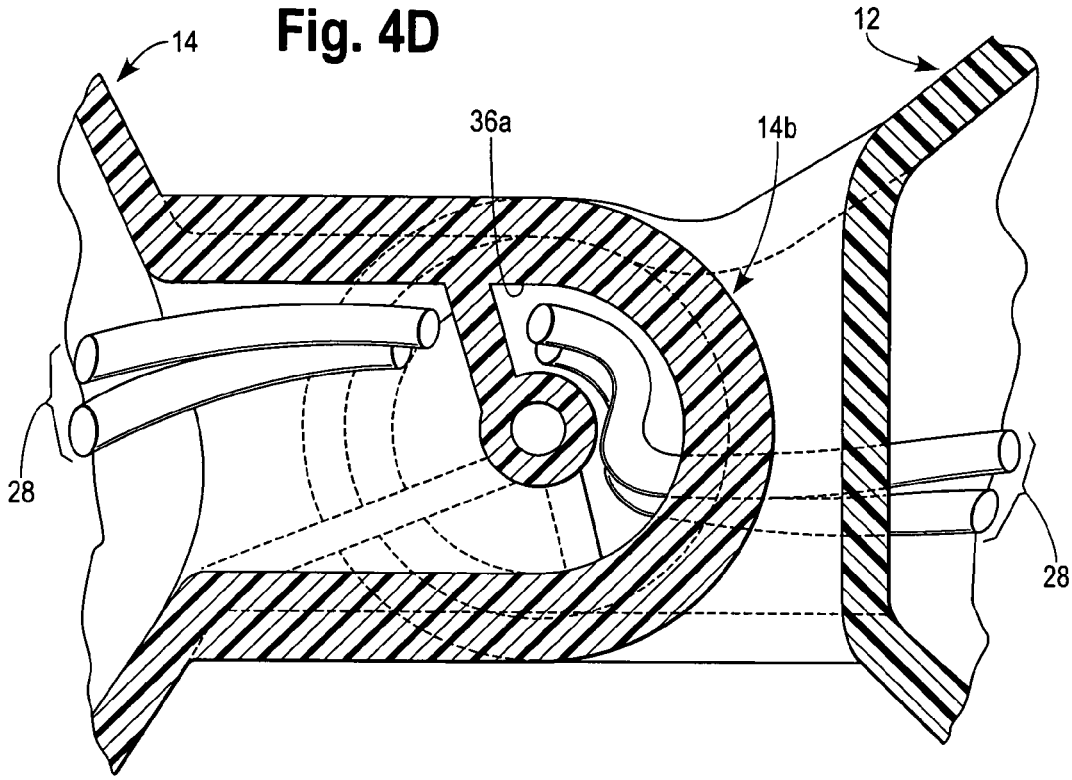
Figure 4E:
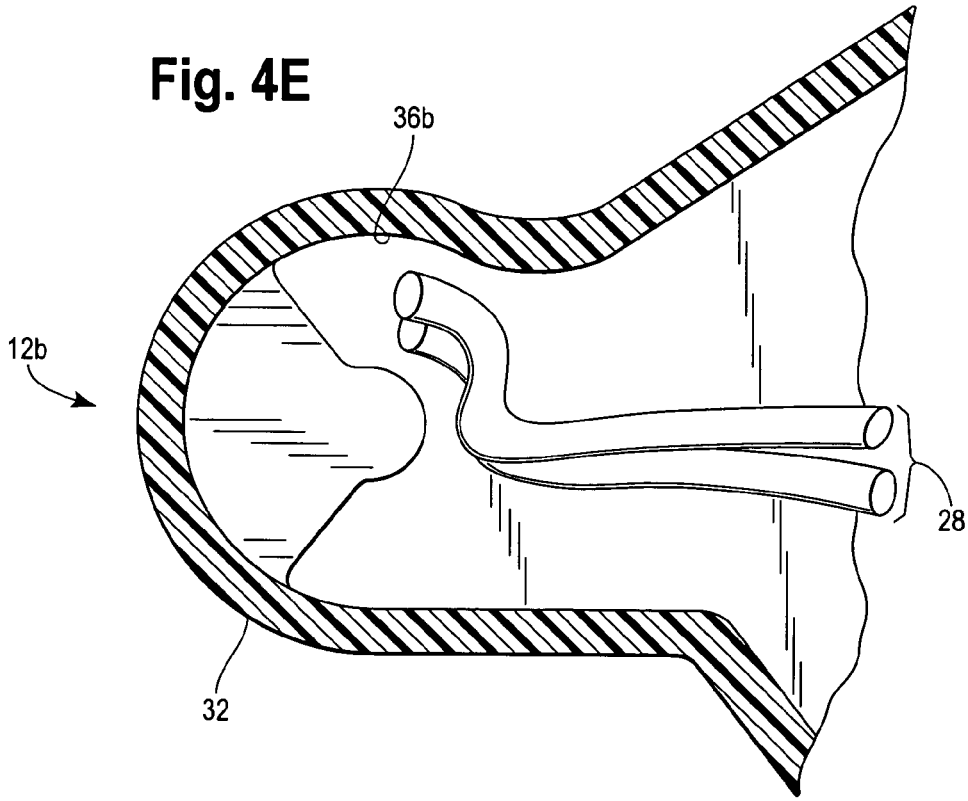

FIGS. 4D and 4E are sectional views taken with respect to planes 4D, 4E of FIG. 4C illustrate respective channels 36*a*, 36*b* through which the wires 28 extend.

Figure 1D:
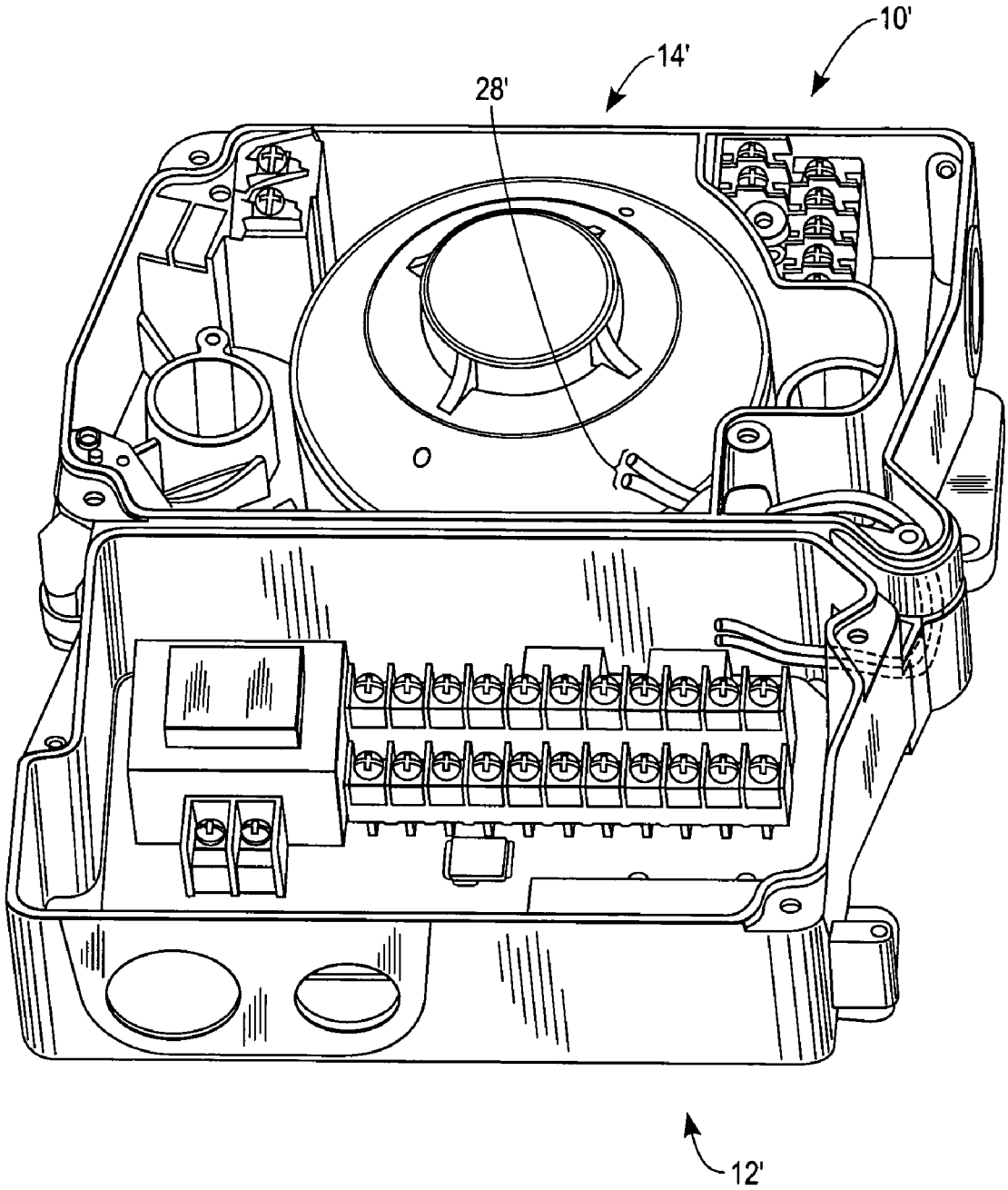
FIG. 1D is an alternate form of an electrical unit in accordance with the invention.

FIG. 1D illustrates an alternate multi-sectional electrical unit 10'. The unit 10' could be configured as an output device, control unit power supply or any other type of electrical unit that needs a multi-sectional housing, sections 12', 14' that are movable relative to one another.

Thus, the hinged sections 12*b*, 14*b* each define an interior conduit having a first and second apertures or ends into which and from which the respective electrical conductors 28 can pass through to the other respective housing section.

Figure 5:
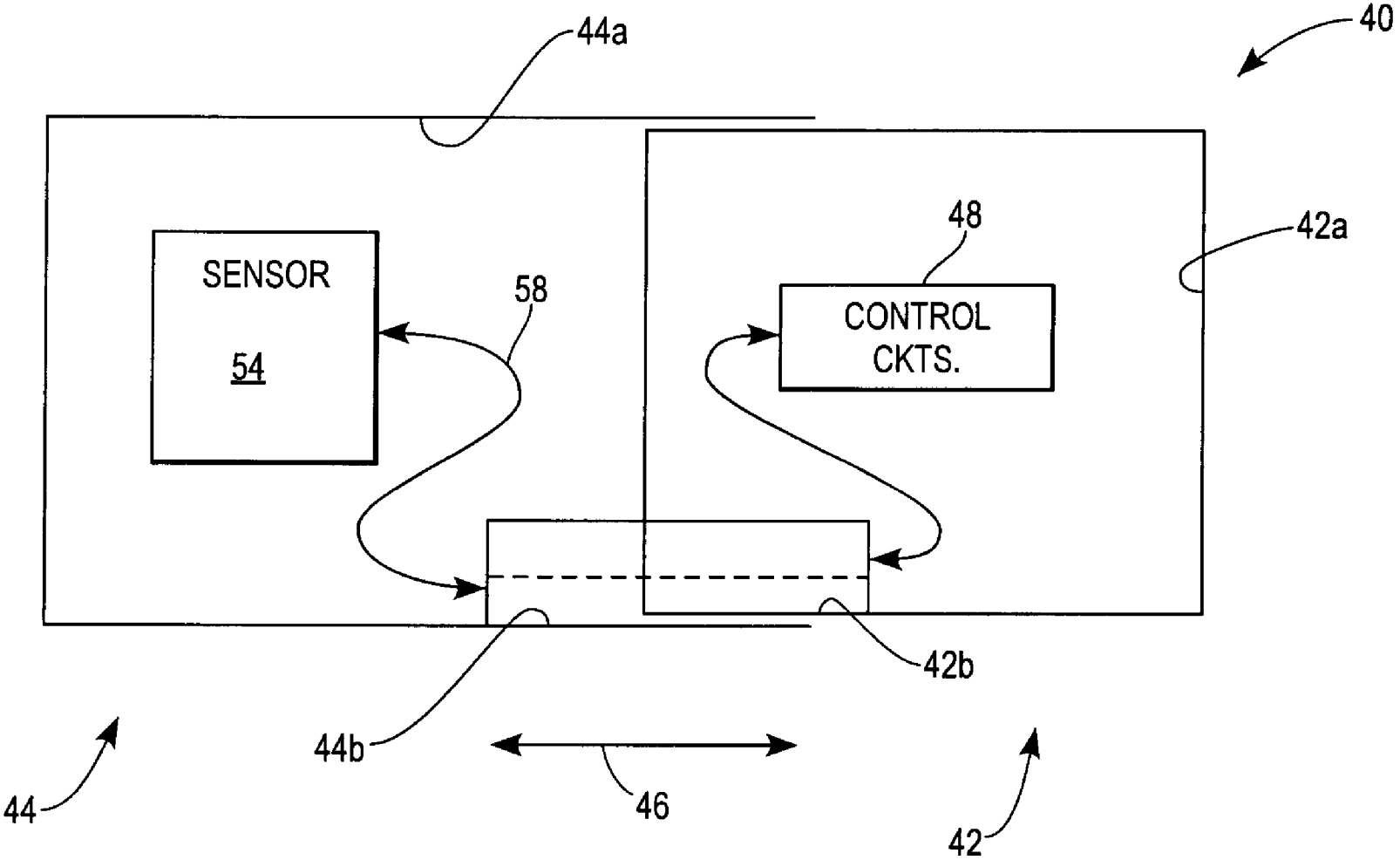
FIG. 5 illustrates an alternate embodiment of the present invention.

An electrical unit in accordance with the invention is formed of slidable housing sections as illustrated in FIG. 5. An electrical unit 40, illustrated in FIG. 5, has first and second housing sections 42, 44 which are slidably coupled to another for linear motion 46 relative to one another. In the configuration of FIG. 5, control circuitry 48 can be electrically coupled to a sensor 54 via electrical conductors 58.

The conductors 58 extend through respective internal channels such as channels 42*b* and 44*b* of the respective housing sections 42, 44. It will be understood that neither the configuration of the control circuitry 48 nor the characteristics of the sensor element 54 are limitations of the present invention.

Thus, as described above, electrical units which embody the present invention provide for variable footprint sizes with potential differing orientations of respective housing sections relative to one another.

By way of further example and not limitation, those of skill in the art will understand that the housing sections 42, 44 could be oriented 90 degrees to one another and in such a configuration could not only be slidable linearly relative to one another but could also be rotatable relative to one another. In all such configurations, a variable length internal channel is provided, extending between to movable housing sections, such that electrical conductors can readily extend between the respective housing sections, completely internal thereto, while at the same time providing the benefit that the footprint of the respective electrical unit can be altered given the physical installation constraints.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. An electrical unit comprising:

first and second housing sections, the sections each define an interior region, the sections are mechanically coupled together and movable relative to one another about an axis of rotation; and at least one electrical conductor which extends between the sections, fully enclosed therein, the conductor extends past the axis of rotation on only a single side thereof.

2. A unit as in claim 1 where one section carries an ambient condition sensor.

3. A unit as in claim 2 where the sensor comprises at least one of a smoke sensor, a gas sensor, a flame sensor, a motion sensor, a position sensor or a thermal sensor.

4. A unit as in claim 1 where the conductor extends through a bounded path.

5. A unit as in claim 4 where the path changes as the sections move relative to one another.

6. A unit as is claim 5 where the mechanical coupling comprises a rotatable, hollow hinge with the path having sections that extend at a variable angle relative to one another as the housing sections rotate.

7. A unit comprising:

a first segment and a second segment pivotably attached to one another so that the segments can move with respect to one another about an axis of rotation;

an ambient condition sensor carried by one of the segments;

a path for an electrical conductor that extends through both segments past the axis of rotation on only a single side thereof.

8. A unit as in claim 7 where the sensor comprises at least one of a smoke sensor, a gas sensor, a flame sensor, a motion sensor, a position sensor or a thermal sensor.

9. A unit as in claim 7 further comprising a first housing section attached to the first segment and a second housing section attached to the second segment wherein the segments slidably engage along the axis of rotation and the housing sections move with respect to one another when the segments are moved about the axis of rotation.

10. A unit as in claim 7 where both segments are hollow with the path having sections that extend at a variable angle relative to one another as the segments rotate.

* * * * *